US008926833B2

(12) United States Patent
Chirinos et al.

(10) Patent No.: US 8,926,833 B2
(45) **Date of Patent: *Jan. 6, 2015**

(54) PROCESS AND SYSTEM IMPROVEMENT FOR IMPROVING AND RECUPERATING WASTE, HEAVY AND EXTRA HEAVY HYDROCARBONS

(75) Inventors: Manuel Chirinos, Edo Miranda (VE); Galanda Morfes, Edo Miranda (VE); Mariángel Alvarez, San Antonio de los Altos (VE); Félix Silva, San Antonio de los Altos (VE)

(73) Assignee: Intevep, S.A., Caracas (VE)

( * ) Notice: Subject to any disclaimer, the term of this patent is extended or adjusted under 35 U.S.C. 154(b) by 203 days.

This patent is subject to a terminal disclaimer.

(21) Appl. No.: 13/430,743

(22) Filed: Mar. 27, 2012

(65) Prior Publication Data

US 2012/0186939 A1 Jul. 26, 2012

Related U.S. Application Data

(60) Division of application No. 12/414,779, filed on Mar. 31, 2009, now Pat. No. 8,147,679, and a continuation-in-part of application No. 11/603,525, filed on Nov. 21, 2006, now Pat. No. 7,854,836.

(60) Provisional application No. 60/817,030, filed on Jun. 27, 2006, provisional application No. 61/140,244, filed on Dec. 23, 2008.

(51) Int. Cl.

| | |
|---|---|
| ***C10G 21/00*** | (2006.01) |
| ***C10G 1/04*** | (2006.01) |
| ***C10G 33/00*** | (2006.01) |
| ***C10G 21/14*** | (2006.01) |

(52) U.S. Cl.

CPC ..... *C10G 21/003* (2013.01); *C10G 2300/308* (2013.01); *C10G 2300/1033* (2013.01); *C10G 1/042* (2013.01); *C10G 2300/206* (2013.01); *C10G 2300/44* (2013.01); *C10G 1/04* (2013.01); *C10G 2300/4081* (2013.01); *C10G 21/14* (2013.01)

USPC ..... 208/390; 208/45; 208/188; 166/267; 166/272.3; 166/279

(58) Field of Classification Search

CPC ..... C10G 21/003; C10G 21/006; C10G 2300/1033; C10G 2300/1003; C10G 2300/4037

USPC ..... 208/45, 188, 309, 390; 166/267, 272.3, 166/279

See application file for complete search history.

(56) References Cited

U.S. PATENT DOCUMENTS

| | | | |
|---|---|---|---|
| 4,017,383 | A | 4/1977 | Beavon |
| 4,211,633 | A | 7/1980 | Gleim |

(Continued)

OTHER PUBLICATIONS

Meyers, Handbook of Petroluem Refining Processes, 2003, 3d Ed., pp. 10-19-10-21.*

(Continued)

*Primary Examiner* — Walter D Griffin
*Assistant Examiner* — Derek Mueller
(74) *Attorney, Agent, or Firm* — Bachman & LaPointe, PC

(57) ABSTRACT

A continuous process for upgrading a heavy hydrocarbon includes the steps of: obtaining a heavy hydrocarbon; heating the heavy hydrocarbon; contacting the heavy hydrocarbon with a solvent at upgrading conditions so as to produce a first product comprising a mixture of upgraded hydrocarbon and solvent and a second product comprising asphaltene waste and water; continuously feeding the first product and the second product to a first separator; heating the first product; and continuously feeding the first product to a second separator to separate the upgraded hydrocarbon from the solvent. A system is also provided.

1 Claim, 4 Drawing Sheets

(56) References Cited

U.S. PATENT DOCUMENTS

| | | | |
|---|---|---|---|
| 4,482,453 | A | 11/1984 | Coombs et al. |
| 4,572,781 | A | 2/1986 | Krasuk et al. |
| 4,747,936 | A | 5/1988 | Penning |
| 4,781,819 | A | 11/1988 | Chirinos et al. |
| 5,944,984 | A | 8/1999 | Benguigui et al. |
| 6,357,526 | B1 | 3/2002 | Abdel-Halim et al. |
| 6,405,799 | B1 | 6/2002 | Vallejos et al. |

OTHER PUBLICATIONS

Perry's Chemical Engineers Handbook , 2008, McGraw-Hill, 8th Ed., pp. 18-36-18-37.*

* cited by examiner

PROCESS AND SYSTEM IMPROVEMENT FOR IMPROVING AND RECUPERATING WASTE, HEAVY AND EXTRA HEAVY HYDROCARBONS

CROSS REFERENCE TO RELATED APPLICATIONS

This application is a divisional application of U.S. Ser. No. 12/414,779 filed Mar. 31, 2009, now U.S. Pat. No. 8,147,679 which claims benefit of U.S. Ser. No. 11/603,525 filed Nov. 21, 2006, now U.S. Pat. No. 7,854,836, which claims the benefit of provisional application No. 60/817,030 filed Jun. 27, 2006. This application also claims the benefit of the filing date of provisional application No. 61/140,244 filed on Dec. 23, 2008.

BACKGROUND OF THE INVENTION

The invention relates to a process and system for improving quality of a heavy and/or extra heavy hydrocarbon, and especially for recovering and improving the quality of hydrocarbons in waste drilling fluids.

Hydrocarbon waste pits are used to store accumulated waste drilling fluids during the process of drilling for the production of oil, as well as during exploitation of a given oil field. During drilling, it is necessary to insert a drill bit and accessories to remove waste sand. In order to facilitate drilling, drilling fluids are used. As the drill bit perforates through the various subterranean formations, the drilling fluids mix with petroleum crude and the resulting mixture of used fluids is disposed of, typically in a pit for intended later treatment.

However, as the accumulation within pits starts to get large, there is no suitable technology for properly treating it. A large amount of crude hydrocarbon is stored within the waste drilling fluids. In some cases, the amount of hydrocarbon present in drilling pits is much greater than the drilling fluid. With time, the fluids in these pits are transferred to large reservoirs from which it is intended to recover at least the hydrocarbon fraction, but this has met with little or no success. Additionally, the waste water and the drilling cuts are not separated for appropriate disposal.

This causes a problem in that many reservoirs are used for accumulating large quantities of waste hydrocarbon products and drilling cuts for years, without any intervention for recovering any product from them. In these waste pits, the amount of hydrocarbons is so large that if recovered, it could be used downstream in a refinery or any other process capable of transforming the recovered hydrocarbon.

Another important issue related to the disposal and accumulation of waste drilling fluids is that pits holding these fluids can contaminate ground water and soil by slow permeation of such fluids through the soil, creating an environmental problem for future generations.

In some instances, such fluids are treated just to the extent of removing water and drilling fluids, while the large amount of hydrocarbon remaining is transferred to another reservoir, typically a much bigger one, which accumulates huge quantities of such hydrocarbons for a very long time, without any treatment whatsoever. The hydrocarbon contained in these reservoirs does not have the quality to be used in any other process. Thus, these large pits or reservoirs are kept indefinitely.

In other instances, waste hydrocarbons contained in such reservoirs are incinerated, which of course wastes the hydrocarbon resource and also leads to environmental issues.

Attempts to recover hydrocarbon are made difficult by the presence of emulsions of water in hydrocarbon which are very difficult to break. Attempts to treat such waste hydrocarbons include a multi-step procedure requiring dilution, demulsification, heating and centrifugation.

Even when this multi-step process is used, the hydrocarbon product obtained has a large quantity of unwanted material that limits or prevents use of the hydrocarbon in downstream refining or other processes.

Clearly, the need exists for a process to recover hydrocarbons from waste hydrocarbon sources such as waste drilling fluid pits and the like.

There is no known technology capable of recovering and improving the quality of waste hydrocarbon products coming from large drilling cut pits, at low cost.

Similar needs are also present in some heavy or extra heavy hydrocarbons produced from a well after production has started. It is known to extract heavy and extra heavy hydrocarbons and treat them through dilution with light or medium hydrocarbons, to produce so-called syncrude. However, such processes are done for transportation purposes, and do not meaningfully improve or upgrade the product.

Extraction of hydrocarbons coming from tar sands or bituminous sands is usually done by using a combination of water, sodium hydroxide and high temperature. This leads to increased costs, and is an environmentally harsh treatment.

Thus, there are further needs for improved methods to produce and upgrade heavy and extra heavy hydrocarbons, and hydrocarbons from tar sands or bituminous sands, at reduced cost and in a more environmentally friendly manner.

De-asphaltation processes are used for improving heavy and extra heavy crude hydrocarbons. Examples of these known processes include U.S. Pat. Nos. 4,017,383; 4,482,453; 4,572,781; 4,747,936; 4,781,819; 5,944,984 and 6,405,799. However, these processes are carried out at severe pressure and temperature which prevent their economic use.

Based upon the foregoing, it is the primary object of the invention to provide a low cost process for recovering and upgrading heavy and extra heavy hydrocarbons from waste drilling fluid pits, reservoirs and the like.

It is a further object of the invention to provide such a process which uses low cost and highly available materials.

It is a further object of the invention to provide a system for carrying out the process which is modular in design and easy to install, use and maintain.

Other objects and advantages of the invention will appear below.

SUMMARY OF THE INVENTION

According to the invention, the foregoing objects and advantages have been attained.

According to the invention, a continuous process for upgrading a heavy hydrocarbon is provided, which comprises the steps of: obtaining a heavy hydrocarbon; heating the heavy hydrocarbon; contacting the heavy hydrocarbon with a solvent at upgrading conditions so as to produce a first product comprising a mixture of upgraded hydrocarbon and solvent and a second product comprising asphaltene waste and water; continuously feeding the first product and the second product to a first separator; heating the separated first product; and continuously feeding the separated first product to a second separator to separate the upgraded hydrocarbon from the solvent.

A system is also provided for upgrading a heavy hydrocarbon, comprising: a first heater continuously feeding a source of a heavy hydrocarbon at a temperature of between about 30°

C. to about 130° C. connected to a reactor that is at a pressure of between about 100 pounds per square inch (psig) and about 350 psig; a solid-liquid density first separator continuously separating the first product containing upgraded hydrocarbon and the solvent from the second product containing asphaltene waste and water is connected to the reactor, wherein the first separator has a first separator first outlet for conveying the first product and a first separator second outlet for conveying the second product; an asphaltene and water storage tank communicated with the first separator second outlet for receiving and storing asphaltene waste and separated water; a second heater at a temperature of between about 35° C. to about 65° C. communicated with the first separator first outlet, wherein the first product is heated in a continuous flow and conveyed through a second heater outlet; a second separator communicated with the second heater outlet, wherein the second separator is a separator with 1 to 5 separation units which continuously separate the upgraded hydrocarbon from the solvent by having a second separator first outlet for conveying the upgraded hydrocarbon and a second separator second outlet for conveying the solvent; a hydrocarbon storage tank communicated with the second separator first outlet for receiving and storing the upgraded hydrocarbon product; and, a compressor communicated with the second separator second outlet for receiving and compressing separated solvent from the second separator, wherein the compressor has an outlet communicated back to the reactor.

BRIEF DESCRIPTION OF THE DRAWINGS

A detailed description of preferred embodiments of the invention follows, with reference to the attached drawings, wherein.

DETAILED DESCRIPTION

Figure 1:
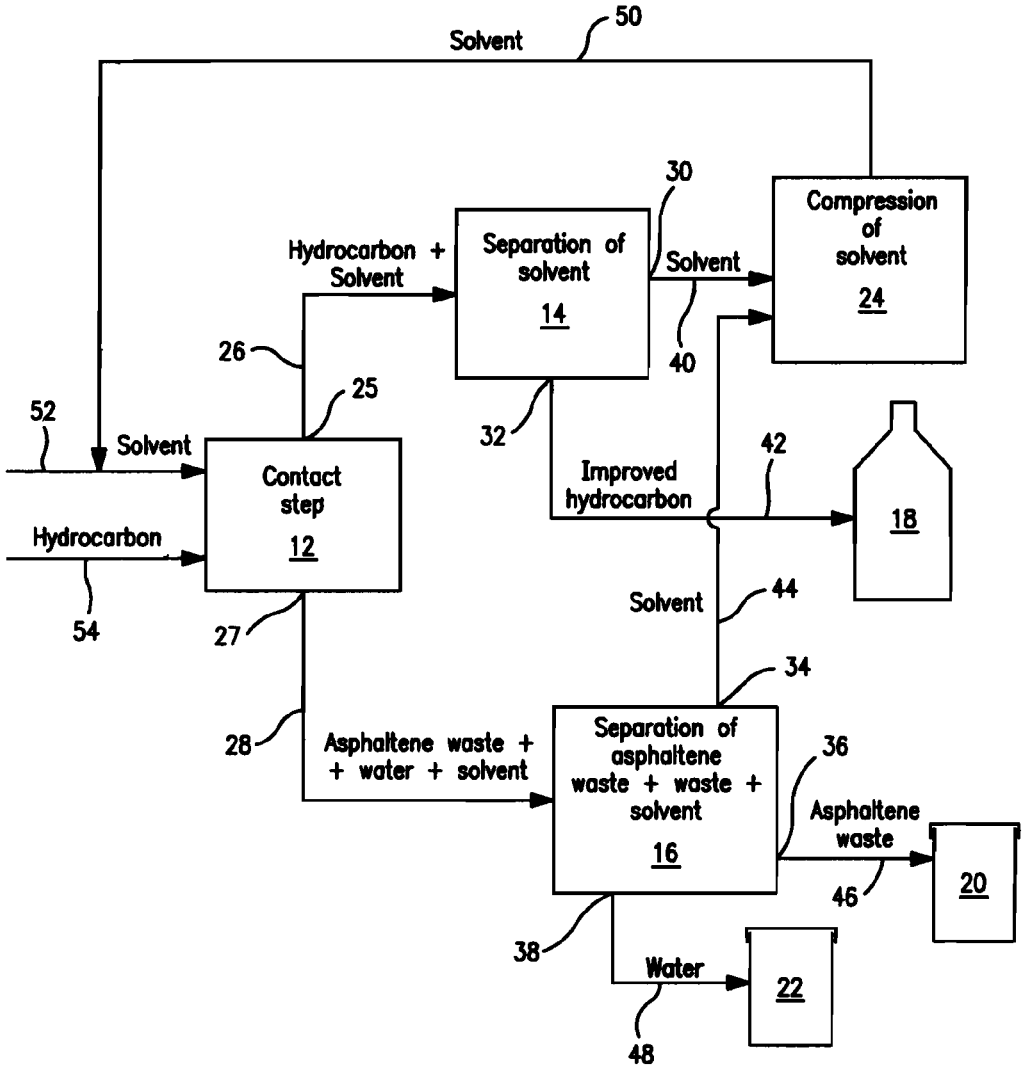
FIG. 1 schematically illustrates one embodiment of the system and process of the present invention.

The invention relates to improvement of heavy hydrocarbons and, more particularly, to an improved process and system for recovering and upgrading heavy hydrocarbons which is economical and effective, and which can be used, for example, to recover and upgrade hydrocarbons from waste drilling fluid pits.

According to the invention, heavy and extra heavy hydrocarbons, hereinafter referred to as heavy hydrocarbons (HC), are recovered and upgraded by contacting with a solvent in a reactor at relatively mild conditions, and then separated to produce an upgraded hydrocarbon which can be useful for further processing and the like. One particularly preferred application of the present invention is in recovering such hydrocarbons from stored waste drilling fluids. Alternatively, the process of the present invention is also useful in producing upgraded hydrocarbon from tar and bituminous sands and the like. The process of the present invention is a de-asphalting process, and the solvent in such processes acts as a liquid-liquid extracting medium, facilitating the precipitation of asphaltene, water and sediments present in the waste hydrocarbon product.

As set forth above, one typical starting material for the process of the present invention is a waste drilling fluid. Such fluid typically contains hydrocarbons mixed and sometimes emulsified in with water, and contain various solids and other materials which complicate processing and use. Physical-chemical characteristics of a typical starting material are described in Table 1 below.

TABLE 1

| Physical-chemical characteristics | Value range |
|---|---|
| Gravity API (°API) | 5-20 |
| Hydrogen content (% w/w) | 9.0-12 |
| Carbon content (% w/w) | 78-85 |
| Sulfur content (% w/w) | 2.0-5.0 |
| Nickel content (ppm) | 60-90 |
| Iron content (ppm) | 100-405 |
| Vanadium content (ppm) | 270-800 |
| Acidity (mg KOH/g) | 0.22-4.5 |
| Saturates (% w/w) | 36.23-57.58 |
| Resins (% w/w) | 19.72-27.33 |
| Asphaltenes (% w/w) | 6.85-12.11 |
| Aromatics (% w/w) | 24.22-47.07 |

Other types of hydrocarbons can be upgraded within the broad scope of the present invention. For example, the process can also be used for upgrading and producing heavy and extra heavy hydrocarbons from subterranean reservoirs.

When the starting hydrocarbon is a waste drilling fluid, care is taken to ensure that any large waste material such as iron debris, logs, etc. are removed. These fluids initially can be pumped to a storage tank near the reactor using vacuum devices, or the system can be deployed near the waste fluid drilling pit. If the waste reservoir is semi-solid, transfer can be done using mechanical arms such as a pailover device to feed a storage tank, or directly to the reactor. Generally, most of these waste drilling pits are liquids with heavy densities that can be vacuum pumped to the reactor zone.

As set forth above, the hydrocarbon starting material is heated in a continuous flow at a temperature range of from about 30° C. to about 130° C.

The heated hydrocarbon starting material is then upgraded by contacting with a comparatively light solvent, preferably a C2-C5 light petroleum fraction. Examples of preferred solvents include but are not limited to propane, liquid petroleum gas (LPG), liquid natural gas (LNG) and mixtures thereof. These are refinery gases, which can readily be obtained from gas and petroleum wells.

According to the invention, solvent and starting hydrocarbon material are contacted in a reactor, and exposed in the reactor to conditions which lead to upgrading of the hydrocarbon. Preferred processing conditions include a temperature of between about 30° C. and about 130° C., and a pressure of between about 100 psig and about 350 psig. The processing time varies depending upon the nature of the hydrocarbon starting material, and is typically between 1 second to 1 minute, if the reaction is continuous; and between 30 and 1,440 minutes if the reaction is done in batch. As will be discussed below, the process is preferably carried out in a continuous fashion, and therefore the reaction time can appropriately be given in terms of residence time within the reactor.

Numerous different reactors can be used to produce the upgrading conditions as set forth above. Further, while the vessel in which the contacting takes place is called a reactor, there are numerous different types of equipment with which the reaction can be carried out, and these other types of equipment are intended to be included broadly within the term reactor. For example, the process can be conducted utilizing a mixer having either mechanical mixing parts, or gas flow mixers, or both, or can be a flow mixer with or without mechanical mixing. Alternatively, the reactor can be a gravity, a static mixer or a cyclonic settler, or a centrifugal sedimenter or the like.

Mixer-sedimenter type reactors are preferred because they provide for mechanical mixing without risk of flooding, and also because they help to avoid the formation of stable emulsions. Such a reactor is a closed receptacle which has mechanical agitation and sedimentation by gravity and/or centrifuge. The continuous reaction of the present invention is preferably carried out in a static mixer.

When a static mixer is used as the reactor the mixing elements within the static mixer may be used to alter the contact and mixing time. Mixing elements are a series of baffles within the static mixer that are made from metal or a variety of plastics. The necessary number of mixing elements depends on the required homogeneity and on the volume flow of the components.

In a batch process, both mixing and sedimentation can be carried out in the same reactor. In this instance, the reactor can be modified in order to accommodate various accessories to improve efficiency.

When the process is carried out as a continuous process, these steps can be carried out sequentially.

After the contacting step, two distinct products or product streams are produced out of the reactor. A first product or product stream is a mixture of upgraded hydrocarbon and solvent. A second product or product stream is made up of asphaltene waste and water.

After the contacting step, in a continuous flow the first product and the second product are fed to a solid-liquid gravity first separator.

The second product, containing asphaltene waste and water, is separated from the first product and discharged into a suitable storage tank or vessel. This material can advantageously be utilized in road building or repair. Soil and other sediments obtained through the process can also be used in various applications. Finally, the water component can be stored and/or treated and recycled to other processes or uses such as irrigating crops.

The first product is typically discharged from the upper outlet of the first separator, while the second product is typically discharged through the lower outlet of the first separator.

The first product, containing upgraded hydrocarbon and solvent, is fed in a continuous flow to a second heating unit. The second heating unit heats the first product at a temperature range of between about 35° C. to about 65° C.

In the second separator the upgraded hydrocarbon is separated from the solvent. The second separator may contain 1 to 5 separation units, preferably 1 to 3 separation units. These individual separation units may be made of any hydrocarbon/solvent separation device that is well known within the art.

The separators used to treat the first and second products can be conventional vertical systems for gas-liquid separation, or can be other types of separators as well, for example, such as cyclonic and/or centrifugal separators.

Through two separate discharge outlets the second separator produces a final upgraded hydrocarbon product and recycled solvent. The upgraded product can be fed to a storage tank or directly to further processing as desired. The solvent can suitably be recycled back to the beginning of the process, for example through a compressor or the like.

Solvent and hydrocarbon are preferably contacted under a controlled weight ratio of hydrocarbon to solvent, which can advantageously be between about 1:1 and about 1:3. As will be illustrated with the examples below, different results are obtained using different ratios of hydrocarbon to solvent. Further, different solvents direct the reaction in different manners, and therefore it is desirable to select the suitable solvent based upon the results desired.

FIG. 1 schematically illustrates one embodiment of a process and system according to the present invention. FIG. 1 shows process 10 including a contacting step 12 which can be carried out in a suitable reactor as discussed above, two separation steps 14, 16, storage tank 18 for storing upgraded hydrocarbon, storage tank 20 for storing asphaltene waste, storage tank 22 for storing water from the process, and a compressor 24 shown schematically as a compression step in FIG. 1.

Contacting step 12 produces a hydrocarbon and solvent stream or product through one outlet 25 to line 26 and an asphaltene waste, water and solvent stream or product through another outlet 27 to line 28. Line 26 leads to a first separator illustrated at step 14 and having two outlets 30 and 32. Line 28 leads to a second separator illustrated at step 16 and having three outlets 34, 36 and 38.

Outlet 30 carries solvent from separator 14 to line 40 to compressor 24. Outlet 32 carries a separated and improved or upgraded hydrocarbon to line 42 to storage tank 18.

Outlet 34 carries separated solvent from separator 16 to line 44 to compressor 24. Outlet 36 carries asphaltene waste from separator 16 through line 46 to storage tank 20. Outlet 38 carries separated water through line 48 to storage tank 22.

Compressor 24 feeds solvent back to the reactor for contacting step 12, through line 50, with or without solvent makeup from solvent source 52.

The hydrocarbon feed to the reactor for contacting step 12 is schematically illustrated as 54 in FIG. 1.

Figure 3:
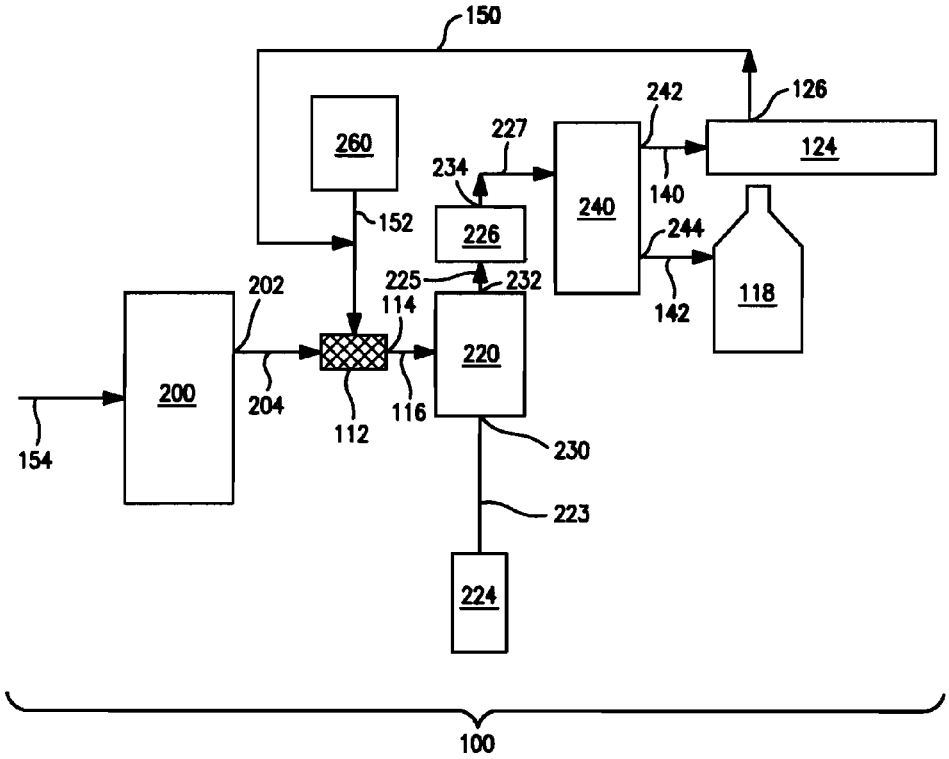
FIG. 3 schematically illustrates an improvement to the FIG. 1 embodiment of the system and process of the present invention; and, FIG. 4 illustrates results obtained in Example 5.

FIG. 3 schematically illustrates an improvement of a process and system according to the present invention. FIG. 3 shows process 100 including a contacting step 112 which can be carried out in a suitable reactor, such as a static mixer, two heating steps 200 and 226, two separation steps 220 and 240, storage tank 118 for storing upgraded hydrocarbon, storage tank 224 for storing asphaltene waste and water from the process, storage tank 260 for storing solvent recycled from the process and solvent not recycled from the process, and a compressor 124.

First heating step 200, continuously heats a stream of heavy hydrocarbon obtained from a source as discussed above to a temperature range of about 30° C. to about 130° C. The heated heavy hydrocarbon 204 exits the heater 200 at outlet 202.

The contacting step 112 is where the heated heavy hydrocarbon 204 meets the stream of recycled 150 and/or non recycled solvent 152. Within the contacting step 112 a reactor, such as a static mixer with the desired number of mixing elements to produce the required homogeneity, is employed to produce a hydrocarbon, a solvent stream/product, an asphaltene waste and water. After the contacting step 112 the resultant mixture is fed through outlet 114 to line 116. Line 116 leads to a solid-liquid density first separator illustrated at step 220 which has two outlets 232 and 230.

Outlet 230 carries asphaltene waste and water from separator 220 through line 223 to storage tank 224. Outlet 232 carries upgraded hydrocarbon and solvent from separator 220 through line 225 to second heater 226.

Second heating step 226, continuously heats the stream of upgraded hydrocarbon and solvent to a temperature range of about 35° C. to about 65° C. The heated upgraded hydrocarbon and solvent 227 exits the heater 226 at outlet 234.

Outlet 234 carries the heated upgraded hydrocarbon and solvent 227 to second separator 240. Second separator 240 contains 1 to 5 differing separation units that are not pictured. Second separator 240 separates the upgraded hydrocarbon from the solvent.

Outlet 242 carries solvent from separator 240 to line 140 to compressor 124. Outlet 244 carries a separated and improved or upgraded hydrocarbon to line 142 to storage tank 118.

Compressor 124 feeds solvent back to the reactor for contacting step 112, through line 150, with or without solvent from solvent storage tank 260.

The heavy hydrocarbon feed to the heating step 200 is schematically illustrated as 154 in FIG. 3.

The two systems illustrated above can be transported in modular form to various locations of interest, for example the site of a waste fluid pit, or a well drilled into a subterranean tar sand formation, and can be used to produce the upgraded hydrocarbon, water, and asphaltene products, starting only with the starting hydrocarbon material and a source of light solvent.

Alternatively, these components can be assembled into a permanent facility and waste fluid transported to that facility. The reactor and separators are all equipment which is readily available and known to a person of skill in the art. The storage tanks can be any suitable vessel for storing the product to be stored, and would also be known to a person skilled in the art.

Example 1

This example demonstrates the process for upgrading a hydrocarbon contained in a hydrocarbon waste fluid mixture from drilling cut waste fluids pits from Eastern Venezuela. This waste fluid mixture has an experimentally measured API gravity of 11.

A sample of approximately 100 g of the mixture was placed in a reactor chamber in ratios of hydrocarbon mixture to solvent (LNG) of 1:1, 1:2 and 1:3 w/w. The amount of solvent used was determined based upon an effective weight of the hydrocarbon after removal from the pit. The reactor was a piston-cylinder type. The contact time between the hydrocarbon mixture and the solvent was set at 48 hrs, at a pressure of 300 psig and a temperature of 60° C. This process was a batch type process.

After the reaction time was reached, the hydrocarbon-solvent fraction from the reactor was sent to a separator through the top outlet of the reactor. Additionally, the bottoms mixture of water, sediment, solvent and asphalting fraction was discharged through the bottom outlet of the reactor. This procedure was repeated four times for each hydrocarbon mixture: solvent ratio. The average results of these procedures are shown in Table 2.

TABLE 2

| Ratio HC:Solvent | Weight of HC mixture in the pit(g) | Effective weight (g) | Weight of LNG (g) | LNG Volume (ml) | Weight of improved HC | °API | % Yield |
|---|---|---|---|---|---|---|---|
| 1:1 | 100.7671 | 86.1559 | 85.9632 | 154.61 | 71.6908 | 27.8 | 83.21 |
| 1:2 | 100.087 | 85.5744 | 184.0749 | 331.07 | 90.2128 | 34.9 | 105.42 |
| 1:3 | 101.4455 | 86.7359 | 280.7299 | 504.91 | 100.9577 | 40.3 | 116.39 |

Note:
HC = hydrocarbon mixture from the pit.

Figure 2:
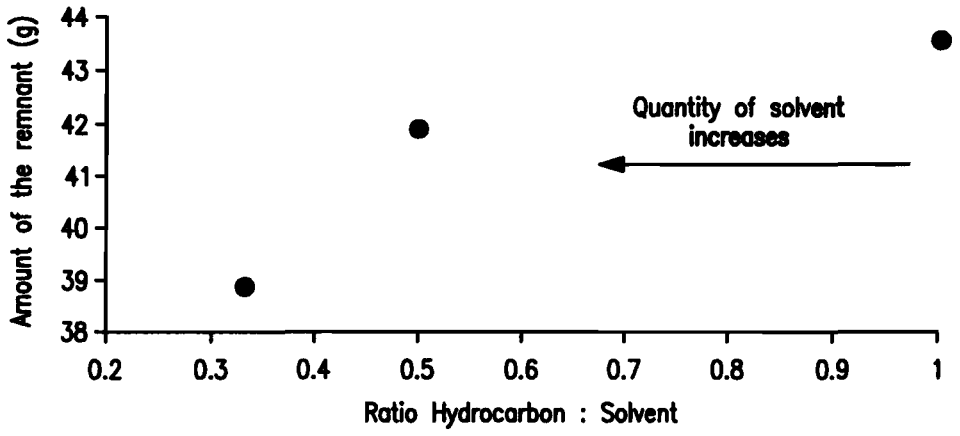
FIG. 2 illustrates results obtained in Example 1.

From the experimental results obtained, the following observations are of interest. First, in all the weight ratios employed (1:1, 1:2, and 1:3), an improvement of the waste hydrocarbon mixture is demonstrated by the increase in API gravity. This gravity increases by 16, 23 and 29 degrees for ratios of 1:1, 1:2 and 1:3, respectively. Second, with increased amounts of solvent, better percentage improvement of the hydrocarbon fraction product is obtained. Third, with increased amounts of solvent, the amount of asphaltene residues produced is lower (See FIG. 2).

In addition to the increase in API gravity; there is a noticeable reduction in the content of asphaltene, vanadium, nickel, iron and sulfur. Table 3 shows the results for this example for the sample where the ratio was 1:1.

TABLE 3

| Properties | Original HC mixture from pits | Improved hydrocarbon |
|---|---|---|
| API Gravity | 11.6 | 27.8 |
| Asphaltene, (% w/w) | 11.64 | 0.32 |
| Sulfur, (% w/w) | 3.2 | 1.81 |
| Iron, (ppm) | 120 ± 6 | 5.9 ± 0.3 |
| Nickel, (ppm) | 69 | 24 |
| Vanadium, (ppm) | 297 | <10 |

Example 2

In this example a mixture of hydrocarbon waste fluid from a waste pit from the Western part of Venezuela was used. The initial API gravity was 11, and the sample contained 14.6-15% water and sediments (% w/s). The hydrocarbon mixture was evaluated using LNG as solvent, and also using propane as solvent, using exactly the same weight to weight ratios as set forth in Example 1. The contact/reaction time was set at 48 hours under a pressure of 300 psig and a temperature of 60° C.

After the reaction time was reached, the separation process was performed as in Example 1. Through the bottom, a solid mixture (asphaltene, sediment, water and some solvent) was discharged. From the top, a recuperated and improved hydrocarbon fraction together with most of the solvent was discharged. After further separation, the final upgraded product was obtained and evaluated, and the results are set forth in Table 4.

TABLE 4

| Sample of HC | Improved HC (°API) | Ratio HC:solvent | Yield (% w/w) |
|---|---|---|---|
| 11.6 °API, 14.6-15% w/s | 27.8 (LNG) | 1:1 | 87.3 |
| | 20 (propane) | 1:1 | 60 |

As indicated in Table 4, API gravity has increased in both runs, using LNG and propane, as compared to the initially calculated API gravity of the hydrocarbon mixture from the drilling cut waste pit from Western Venezuela. This increase in API gravity was between about 10 to about 16 degrees. There is a difference in the percentage of hydrocarbon recovered from the waste mixture depending upon the solvent. Specifically, LNG offers better recovery than propane. One advantage of using propane, however, is the higher selectivity for extracting light hydrocarbon components from the waste hydrocarbon mixture.

Example 3

This example demonstrates the use of the present invention for improvement of a hydrocarbon residue from a distillation process, at 400° C., of a hydrocarbon with API gravity of 16. The residue had a starting API gravity of 8. The Example also provides an example for improvement of an extra heavy hydrocarbon (8° API) from the Venezuelan Orinoco Oil Belt. For this example, the sample was taken directly from the formation. In both cases, the experimental process was carried out using LNG as solvent, using a 1:1 w/w ratio of hydrocarbon to solvent. The deasphalting process conditions were a pressure of 300 psig and a temperature of 60° C., for a time period of 48 hours, in a batch reactor. The results are as set forth in Table 5.

TABLE 5

| Sample of Hydrocarbon | Improved Hydrocarbon | Ratio HC:solvent | Yield (% w/w) |
|---|---|---|---|
| Distilled (8° API) | 26.6 (LNG) | 1:1 | 62.84 |
| Virgin (8° API) | 24.1 (LNG) | 1:1 | 89.08 |

As observed in Table 5, for the hydrocarbon residue coming from the distillation unit, an improvement in API gravity is observed, increasing from 8 to 26.6° API, with a product yield of about 63%. In the second case, with a sample directly from the formation, extra heavy hydrocarbon from the Orinoco Oil Belt region, is improved in API gravity from 8 to 24 with a product yield of 89% weight product.

Example 4

This example demonstrates the improvement, dehydration and desalting of an extra heavy hydrocarbon from Western Venezuela (8° API) in the form of an emulsion with salty water (22% water content in a W/O emulsion). The initial mixture contained a 1 to 1 ratio of extra heavy hydrocarbon to LNG under the conditions used in Example 1. The results are shown in Table 6.

TABLE 6

| XHHC/LNG Ratio | W/O Emulsion weight (g) | Effective weight (g) | Effective salt content in initial mixture (PTB) | Amount of salt in improved hydrocarbon (PTB) | °API of HC product | % Yield |
|---|---|---|---|---|---|---|
| 1:1 | 99.99 | 79.59 | 7000 | <0.1 | 21.6 | 79.84 |

NOTE:
XHHC = extra heavy hydrocarbon

Table 6 shows a great increase in API gravity, from 8 to 21.6, for the improved hydrocarbon product. Additionally, the salt content in the improved hydrocarbon, in pounds per thousand barrel (PTB), drops drastically to less than 1 PTB, indicating excellent desalting. The water content in the improved hydrocarbon also dropped to nearly zero, indicating a complete dehydration of the starting hydrocarbon/water (HC/W) emulsion.

Example 5

This example demonstrates the process for upgrading a hydrocarbon contained in a hydrocarbon waste fluid mixture from drilling cut waste fluid pits from Eastern Venezuela. This waste fluid mixture has an experimentally measured API gravity of 8° API to 11° API.

This experiment evaluates the use of a static mixer and the number of mixing elements used as they relate to the reaction time in the static mixer. The reaction time was evaluated and compared between the addition of 0, 4, 8 and 12 mixing elements. Four reactions were compared and evaluated. Each reaction contained a solvent:hydrocarbon ratio of 1:1. The reaction temperature was held at 60° C. and the pressure was maintained at 300 psig. The continuous flow was set at 50 ml/min.

As the number of mixing elements in the reaction increased the reaction time also increased. The reaction time and other parameters are shown in Table 7.

TABLE 7

| Number of Mixing elements | Ratio HC:Solvent | Yield (% w/w) | °API of HC product | Residence Time (sec) |
|---|---|---|---|---|
| 0 | 1:1 | 39.62 | 39 | — |
| 4 | 1:1 | 79.46 | 26.2 | 3.10 |
| 8 | 1:1 | 80.54 | 26.5 | 6.21 |
| 12 | 1:1 | 81.85 | 28.4 | 9.31 |

NOTE:
API gravity of original HC = 8

Table 7 shows when the hydrocarbon is passed through the mixer without a mixing element, the flow rate is very fast and conversion is at a minimum; therefore, separation at the first separation step is difficult. As the number of mixing elements is increased in the static mixer, the percent yield and API gravity also increases. Furthermore, as the number of mixing elements in the static mixer increases, the reaction time also increased. This is due to the increased length of the static mixer which leads to an increase in the contact area between liquids.

Additional experiments also show that the asphalting content in the upgrading hydrocarbon is reduced as the number of mixing elements is increased. This reduction in the asphalting content improves the API gravity of the hydrocarbon.

Figure 4:
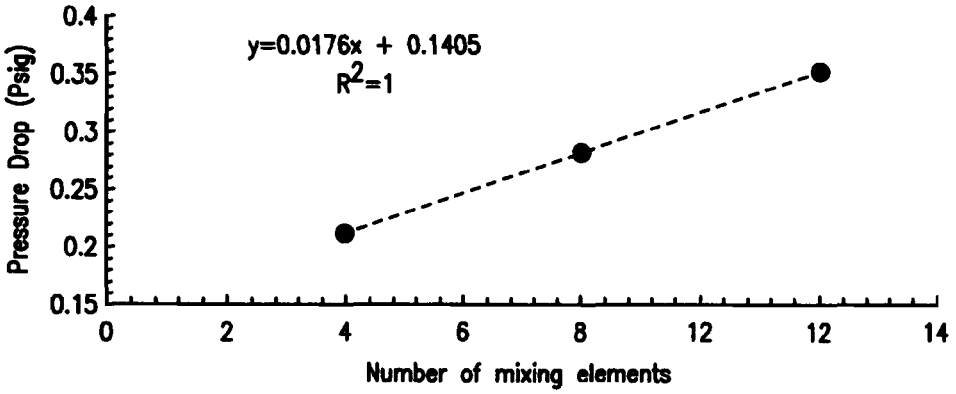

Pressure experiments performed using the same reaction conditions as Example 5 showed an increase in pressure as the number of mixing elements increased. (See FIG. 4). Since there is no need to use additional equipment or parts to increase and/or maintain the pressure within the system, the efficient and economic nature of the present invention is preserved.

The above Examples show that the process of the present invention meets the objectives set forth, and provides for recovery and upgrading of hydrocarbons from waste drilling fluids for example stored in drilling cut pits. Further, the process of the present invention produces these results while also producing water for agricultural use, apshaltene products for road building and repair, and soil/sedimentation which can also be used in agricultural applications. The process provides a substantial increase in API gravity and an excellent yield rate. Further, the hydrocarbon also shows excellent reduction in various other undesirable components. Thus, the process and system of the present invention advantageously solve the problems set forth above.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for upgrading a heavy hydrocarbon from a waste drilling fluid storage pit, comprising the steps of:

transporting a system to a waste fluid drilling pit; the system comprising:

a first heater for heating heavy hydrocarbon; a reactor comprising a static mixer operating at a temperature of up to 130° C. and a pressure of up to 350 psig communicated with the first heater and a source of solvent for both mixing and upgrading the heavy hydrocarbon, wherein the reactor has an outlet;

a first separator communicated with the outlet of the reactor, wherein the first separator is a solid-liquid density separator for separating a first product containing upgraded hydrocarbon and solvent from a second product containing asphaltene waste and water, and having a first outlet for conveying the first product and a second outlet for conveying the second product;

an asphaltene and water storage tank communicated with the second outlet of the first separator for receiving and storing asphaltene waste and separated water;

a second heater communicated with the first outlet of the first separator, for heating the first product, the second heater having an outlet;

a second separator communicated with the outlet of the second heater, wherein the second separator comprises 1 to 5 separation units for separating an upgraded hydrocarbon from solvent and having a first outlet for conveying the upgraded hydrocarbon and a second outlet for conveying the solvent:

a hydrocarbon storage tank communicated with the first outlet of the second separator for receiving and storing the upgraded hydrocarbon product; and, a compressor communicated with the second outlet of the second separator for receiving and compressing separated solvent from the second separator, wherein the compressor has an outlet communicated back to the reactor;

and communicating the first heater with heavy hydrocarbon from the waste drilling fluid pit.

* * * * *